United States Patent [19]

Vest et al.

[11] 4,369,528

[45] Jan. 25, 1983

[54] GARMENT FOR MAINTAINING BODY TEMPERATURE AND METHOD OF MAKING SAME

[75] Inventors: H. Ryland Vest, Raleigh; Walter S. Boone, Valdese, both of N.C.

[73] Assignee: Alba-Waldensian, Inc., Valdese, N.C.

[21] Appl. No.: 236,667

[22] Filed: Feb. 23, 1981

[51] Int. Cl.[3] ..... A41D 13/00

[52] U.S. Cl. ..... 2/69; 2/90; 2/114; 2/409; 2/DIG. 7; 66/176; 66/177; 128/379; 2/243 R

[58] Field of Search ..... 2/400, 402, 69, 73, 2/74, 90, 404, 109, 114, DIG. 7, 409, 243 R; 66/176, 177, 200; 128/375, 402, 379

[56] References Cited

U.S. PATENT DOCUMENTS

| | | | |
|---|---|---|---|
| 26,663 | 1/1860 | French | 128/379 |
| 256,532 | 4/1882 | Appleton | 2/409 |
| 391,007 | 10/1888 | Munsing | 2/404 |
| 824,456 | 6/1906 | Walter | 128/379 |
| 1,808,290 | 6/1931 | Clements | 2/404 |
| 3,211,153 | 10/1965 | Gambetti | 128/379 |
| 3,610,251 | 10/1971 | Sanderson | 128/379 |
| 3,738,367 | 6/1973 | Hardy | 128/379 |
| 3,999,037 | 12/1976 | Metcalf | 128/379 |
| 4,016,868 | 4/1977 | Allison | 128/379 |

*Primary Examiner*—H. Hampton Hunter

*Attorney, Agent, or Firm*—Bell, Seltzer, Park & Gibson

[57] ABSTRACT

A method and garment is provided for maintaining the body temperature of a patient undergoing surgery in an operating room where the ambient temperature is normally below the normal body temperature. The garment is constructed of cut segments of stretchable circular knit seamless fabric and includes arm and leg portions which extend beyond the length of the corresponding hands and feet of the patient. The cut segments are oriented so that the free open ends of the components of the garment are formed by the ends of the cut segments which will not ravel and it is not necessary to seam or hem the free open ends. The garment is constructed in an economical manner so that the garment may be disposed of after the surgical procedure is completed and the stretchable knit fabric provides a snug fit on a wide range of body sizes and shapes.

14 Claims, 14 Drawing Figures

GARMENT FOR MAINTAINING BODY TEMPERATURE AND METHOD OF MAKING SAME

FIELD OF THE INVENTION

This invention relates generally to a garment for maintaining body temperature and to the method of making same, and more particularly to such a garment for maintaining the body temperature of a patient undergoing surgery in an operating room where the ambient temperature is normally below the normal body temperature. The garment covers substantially the entire body of the patient and is formed of stretchable knit fabric in such a manner that the garment can be disposed of after a single use.

BACKGROUND OF THE INVENTION

When brought to the operating room, a surgery patient is normally clothed with an operating gown with an open back and the gown usually extends down to the middle of the thighs with short or no sleeves. This type of garment provides very little warmth to the patient while in the operating room and is of little aid in maintaining the body temperature of the patient.

The need to control the temperature of the body of patients has long been recognized. For example, U.S. Pat. No. 26,663, issued Jan. 3, 1860, discloses a garment made of India-rubber or the like and including tubular passageways extending therein so that water of the proper temperature can be passed therethrough to maintain the proper temperature of the body of the patient. U.S. Pat. No. 3,738,367 also discloses a body temperature control garment made of a stretchable fabric with fluid flow lines attached to and extending throughout the garment for passing water of the proper temperature therethrough. However, these garments are too expensive to be disposed of after a single use, and they are not suitable for use in operating rooms because it is desirable for the doctor to be able to cut the garment and expose the area of the body where the operation is to take place and the cutting of this type of garment would be economically destructive.

Also, it has long been recognized that body temperature can be retained by wearing long underwear which is manufactured in various sizes so that it will fit the wearer in a snug manner. However, this type of underwear is not satisfactory for use by patients undergoing surgery because it is too expensive to manufacture to be disposable, it is not normally of sufficient stretchability to fit a wide range of sizes of wearers, and it does not normally cover the hands, feet and head of the wearer where a large amount of body heat can be lost during operations.

SUMMARY OF THE INVENTION

With the foregoing in mind, it is an object of the present invention to provide a method and garment for maintaining the body temperature of a patient undergoing surgery in an operating room where the ambient temperature is normally maintained below the normal body temperature. The garment is constructed of stretchable knit fabric in such a manner as to require very little cutting and seaming in the manufacture of the garment so that the garment may be sold at a sufficiently low cost so that the garment may be disposed of after a single use.

The garment of the present invention preferably covers substantially the entire body of the patient and includes a shirt type upper body portion including an upper trunk covering portion of sufficient length to cover and extend beyond and below the waist of the wearer and with the sleeves being of a sufficient length to cover and extend beyond the hands of the wearer. The garment also includes a lower body portion with a pair of legs which cover at least the entire upper legs and the feet of the wearer.

In one embodiment of the garment, the legs are connected together at the upper end by a U-seam to form a lower trunk covering portion extending upwardly to the waist and the lower ends of the legs have free open lower ends which extend beyond the feet of the wearer. In another embodiment of the garment, the lower body portion includes separate legs which extend upwardly to the upper ends of the legs and the lower ends are seamed closed to completely cover the feet of the wearer. A cap is provided with each embodiment of the garment and is formed by seaming one end of a tubular knit fabric and the cap may be stretched to cover the head of the patient.

The garment of the present invention is preferably formed of a stretchable true rib knit fabric with the stitch loops in adjacent single needle wales facing in opposite directions. This type of fabric provides sufficient stretchability to the garment that the garment can be manufactured in one size and it will stretch to fit the normal range of adult patient sizes. The fabric is knit of an absorbent yarn, such as cotton yarn, and the various portions of the garment are formed from seamless circular knit tubes so that very little cutting and seaming is required to finish the garment.

A minimum amount of seaming is required to form each embodiment of the garment because the various components forming the garment are cut from lengths of seamless circular knit tubes to take advantage of the known nonraveling characteristic of one raw end of any such cut segment. Thus, the cut circular knit segments must be properly oriented so that the raw ends that will ravel are seamed and the nonraveling raw cut ends are located to define the free opened ends of the garment components such as the lower edge of the cap, the lower ends of the sleeves, the lower end of the trunk covering portion of the upper body portion, and the free ends of the legs.

BRIEF DESCRIPTION OF THE DRAWINGS

Other objects and advantages will appear as the description proceeds when taken in connection with the accompanying drawings, in which:

FIG. 5-A is a fragmentary view of the upper right-hand portion of FIG. 5 and illustrating the manner in which the fabric will ravel from one end;

DESCRIPTION OF THE EMBODIMENT ILLUSTRATED IN FIGS. 1-5

Figure 1:
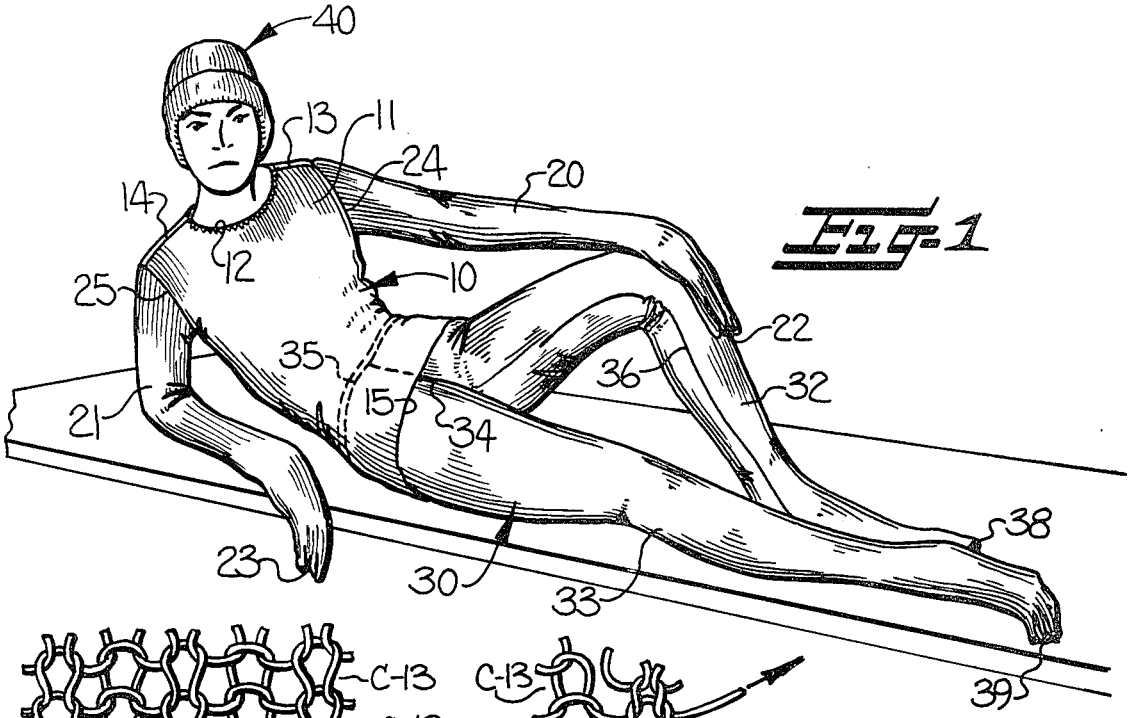
FIG. 1 is a perspective view of one embodiment of the garment of the present invention, illustrating the garment as it appears when being worn by a patient preparatory to a surgical operation.

The garment includes a shirt type upper body portion, broadly indicated at 10, and including a tubular seamless knit upper trunk covering portion or body 11 with a neck opening 12 and shoulder seams 13, 14 extending from the neck opening 12 to sleeve openings in the upper portion of the body 11. The body 11 has a raw cut lower edge forming a nonraveling free open lower end 15 with the body 11 being of a sufficient length to cover and extend beyond the waist of the wearer. As illustrated in FIG. 1, the lower end 15 of the body 11 terminates at substantially the crotch of the wearer.

Figure 6:
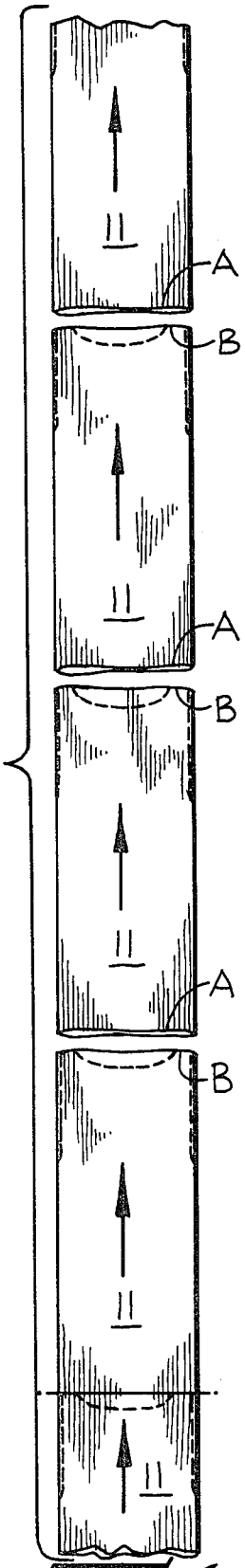
FIG. 6 illustrates the manner in which the trunk covering components of the garment are cut from a circular knit seamless fabric tube.

The circular knit seamless stretchable fabric from which the body 11 is cut is twelve inches wide (in the flattened and relaxed condition shown in FIG. 6). The tubular fabric is knit in the direction indicated by the arrows in FIG. 6 and is transversely cut into 27-inch lengths to provide cut segments containing opposing cut ends, indicated at A and B.

Since the knit fabric will not ravel in the direction in which it is knit, the cut end A of each cut segment will not ravel while the other cut end B will ravel. Therefore, the cut segments must be properly oriented so that the nonraveling raw cut end A forms the free open lower end of the body 11 while the raveling raw cut end B forms the upper end of the body 11.

The body 11 is formed in this manner so that it is not necessary to seam or hem the nonraveling raw cut end A. One layer of the fabric is cut along the curved dotted line (FIG. 6) at the cut end B to form the neck opening 12 and opposite sides of the tube are longitudinally slit, as indicated by the dotted lines, to form openings for attachment of the sleeves. In order to prevent raveling around the neck opening 12, a suitable overedge seam is formed around the neck opening 12.

Figure 5:
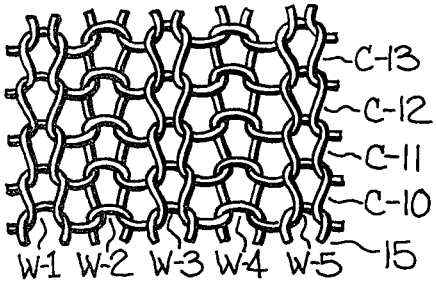
FIG. 5 is a greatly enlarged fragmentary view of the knit fabric enclosed by the rectangle 5 in FIG. 2.
Figure 5A:
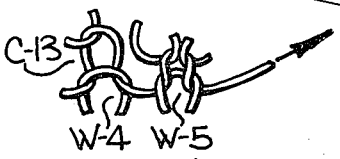
Figure 4:
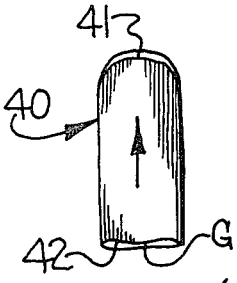
FIG. 4 is an elevational view of the cap shown in FIG. 1 and in flattened and relaxed condition.

As illustrated in FIG. 5, the knit tubular fabric is knit from the bottom to the top and forms stitch loops in the needle wales of successive courses, indicated at C-10 through C-13. The stitch loops in alternate single wales, the odd numbered wales, W-1, W-3, and W-5, face outwardly or toward the observer and the stitch loops in the remaining alternating single wales therebetween, wales W-2 and W-4, face inwardly or away from the observer to form what is known as a one-by-one true rib knit fabric. The lower edge 15 of the body 11 is formed by simply cutting the fabric in a coursewise direction and the fabric will not ravel from this raw cut edge 15 because the fabric is knit in a direction away from the edge 15. FIG. 5-A illustrates the manner in which the fabric will ravel in the opposite direction. When the yarn of course C-13 is pulled, as shown, the stitch loop in course C-13 and wale W-5 becomes smaller and pulls through the stitch loop in course C-12 of wale W-5. With continued pulling of the yarn, the successive stitch loops are pulled through the stitch loops knit in preceding courses so that the fabric ravels in this direction.

Figure 2:
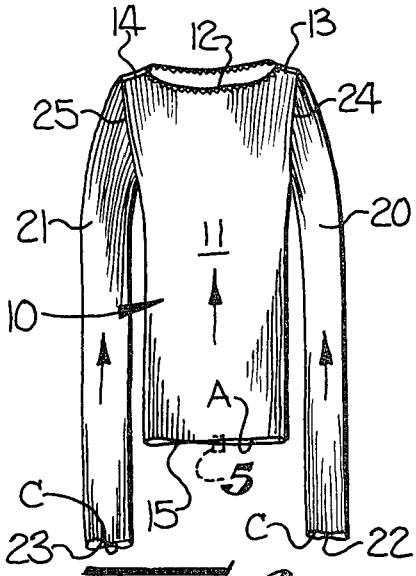
FIG. 2 is a front elevational view of the upper body portion of the garment shown in FIG. 1 and in flattened and relaxed condition.

The upper body portion 10 also includes a pair of tubular seamless sleeves 20, 21 which are four inches wide when in relaxed and flattened condition, as illustrated in FIG. 2, and substantially thirty-four inches long. The sleeves 20, 21 have raw cut lower edges forming respective free open lower ends 22, 23 and are of a sufficient length to cover and extend beyond the hands of the wearer, as illustrated in FIG. 1.

Figure 7:
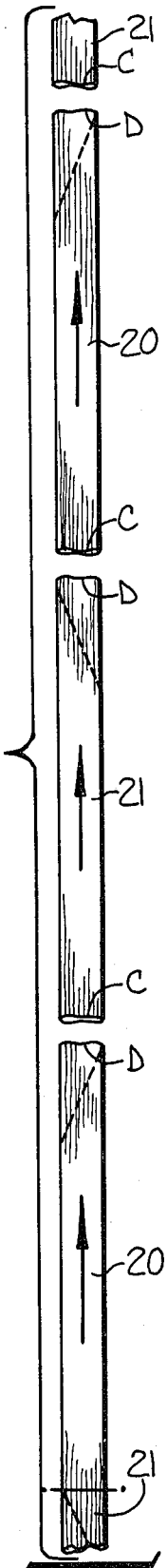
FIG. 7 illustrates the manner in which the sleeve components of the garment are cut from a circular knit seamless fabric tube.

The sleeves 20, 21 are formed from segments cut from a length of circular knit seamless fabric (FIG. 7) with the direction of knitting being indicated by the arrows to provide lower ends C which will not ravel and upper ends D which will ravel. The cut segments are oriented so that the nonraveling ends C form the free open lower ends 22, 23 of the respective sleeves 20, 21. The upper ends of the sleeves 20, 21 are cut at angles, as indicated in dotted lines in FIG. 7, and are seamed to the sleeve openings of the body portion 11 by respective seams 24, 25.

Since the cut segments forming the body 11 and the sleeves 20, 21 are knit in an upward direction, as indicated by the arrows in FIG. 2, the corresponding cut raw edges 15, 22 and 23 do not need to be seamed or hemmed and this reduces the cost of producing the upper body portion 10 of the garment. Also, the stretchability of the fabric adjacent the edges is not restricted, as it might be if the edges were seamed or hemmed.

Figure 3:
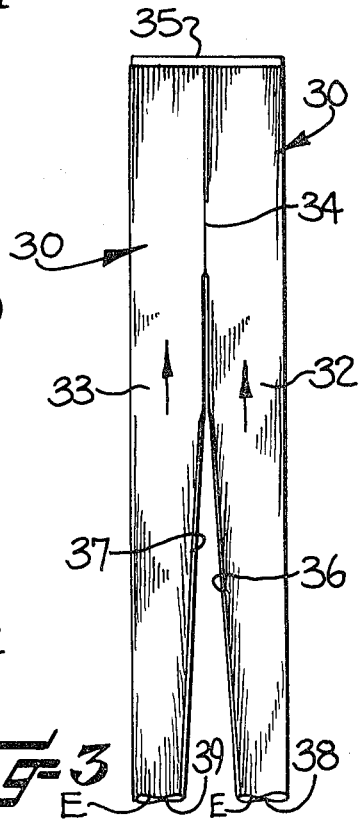
FIG. 3 is an elevational view of the lower body portion of the garment shown in FIG. 1 and in a flattened and relaxed condition.

The garment also includes a lower body portion, broadly indicated at 30. The lower body portion 30 includes a pair of tubular seamless legs 32, 33 which extend upwardly to the waist and are longitudinally slit and joined together by a U-seam 34 to provide a lower trunk covering portion covering the stomach and rear of the wearer. An elastic waistband 35 is suitably attached to the upper ends of the seamless legs 32, 33. The inner portions of the legs 32, 33 are preferably longitudinally seamed, as indicated at 36, 37, to provide inwardly tapered lower leg portions extending downwardly to the raw cut lower edges forming the free open lower ends 38, 39. The portions of the legs 32, 33 immediately below the U-seam 34 are six inches wide when in relaxed and flattened condition, as shown in FIG. 3, and the seams 36, 37 inwardly taper the lower portions of the legs downwardly with the lower ends 38, 39 being approximately four inches wide in the flattened and relaxed condition, as shown in FIG. 3. The overall length of the lower body portion 30 is approximately fifty-one inches.

The legs 32, 33 are formed from segments cut from a length of circular knit seamless fabric (FIG. 8) with the direction of knitting being indicated by the arrows to provide lower ends E which will not ravel and upper ends F which will ravel. The cut segments are oriented so that the nonraveling ends E form the free open lower ends 38, 39 of the respective legs 32, 33.

Figure 8:
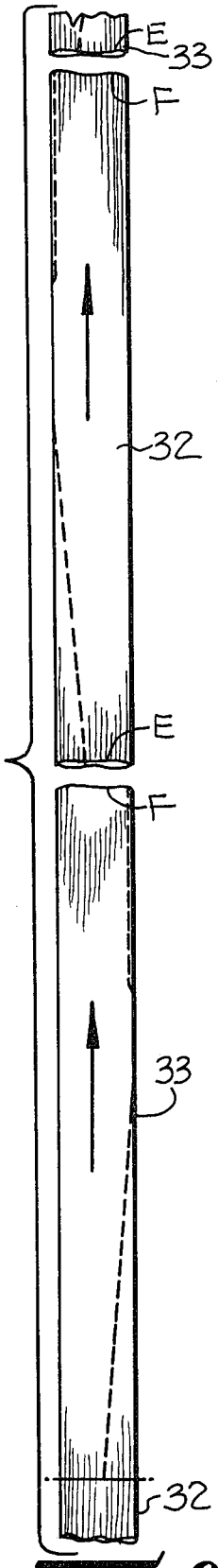
FIG. 8 illustrates the manner in which the leg components of the garment are cut from a circular knit seamless fabric tube.

The upper end portions of the cut leg segments 32, 33 are slit longitudinally, as indicated in dotted lines in FIG. 8, so that the legs may be seamed together by the U-seam 34. The lower end portions of the cut leg segments 32, 33 are cut and seamed to provide an inward taper, as indicated by the dotted lines in FIG. 8.

Since the knit fabric will not ravel in the direction in which it is knit, the free open lower ends 38, 39 of the legs 32, 33 do not need to be seamed or hemmed. While the upper ends of the legs 32, 33 would normally ravel, the waistband 35 is seamed to the upper ends of the legs so that they will not ravel.

Figure 9:
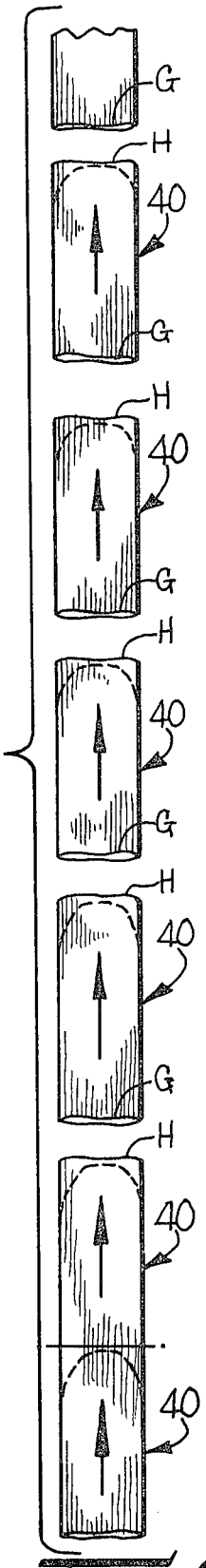
FIG. 9 illustrates the manner in which the cap components of the garment are cut from a circular knit seamless fabric tube.

The garment of FIGS. 1–5 also includes a cap, broadly indicated at 40, which is formed of the same type of circular knit seamless fabric as is used to form the legs 32, 33. The upper end of the cap 40 is closed by a curved seam 41 and the raw cut lower edge forms a nonraveling free open lower end 42. The seamless tubular fabric (FIG. 9) is knit in the direction indicated by the arrows and is cut transversely to provide cut segments including lower ends G which will not ravel and upper ends H which will ravel. The cut segments are each six inches wide and thirteen inches long, when flattened and relaxed, as illustrated in FIG. 9. The cut segments must be properly oriented so that the nonraveling cut end G forms the free open lower end 42 of the cap 40. When drawn on the head of the wearer, the free open lower end 42 may be folded or rolled upwardly, as illustrated in FIG. 1, to leave the face of the patient exposed.

As illustrated in FIG. 1, the garment of the present invention covers substantially the entire body and the patient is brought to the operating room wearing the garment. Since the sleeves 20, 21 and the legs 32, 33 are much longer than the length of the corresponding arms and legs of the patient, these parts of the garment will normally extend beyond the hands and feet, as shown in FIG. 1. However, the free ends of the arms 20, 21 and legs 32, 33 may be folded up so that the hands and/or feet of the patient are exposed, if desired. Depending upon the area in which the operation is to be performed, the doctor may either move a portion of the garment out of the operating field or he may cut away a portion of the garment in the area where the operation is to take place. The remaining portion of the garment covers the patient and aids in retaining the body temperature during the operation and during the following recovery period.

The garment of the present invention may be inexpensively produced because a minimum number of cutting and seaming operations are required to produce the garment. As has been discussed, the free open ends of each portion of the garment are formed by merely cutting the material and do not require seaming or hemming. This is made possible by orienting the various components of the garment so that they are cut from the seamless tubular fabric with the portion of the garment adjacent the cut raw edges extending in the same direction as the fabric is knit so that the raw cut edges do not ravel.

DESCRIPTION OF THE EMBODIMENT ILLUSTRATED IN FIGS. 10–13

Figure 10:
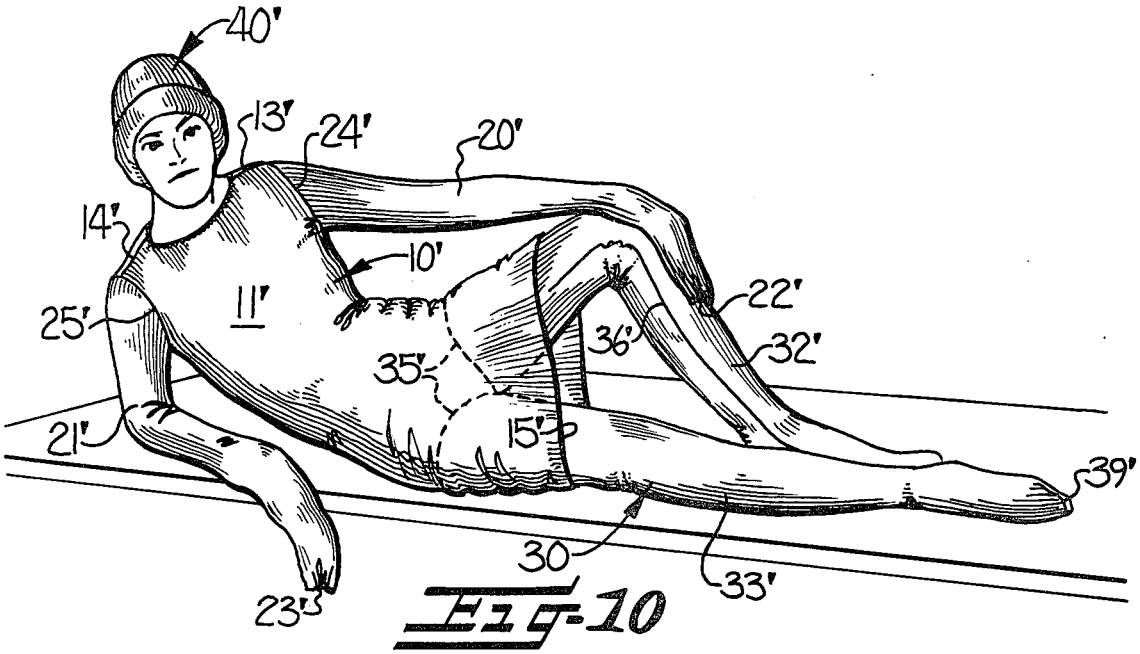
FIG. 10 is a view similar to FIG. 1 but showing another embodiment of the garment of the present invention.
Figure 11:
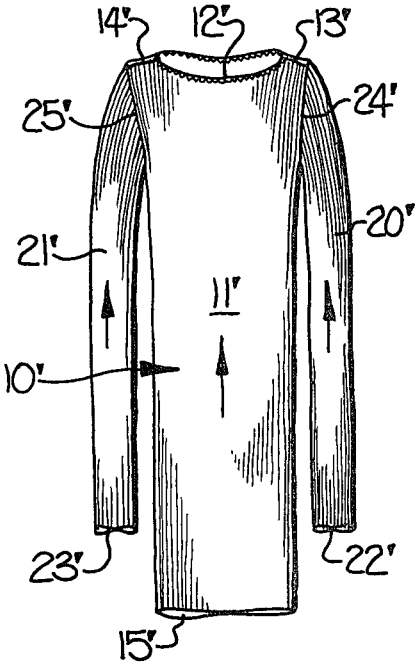
FIG. 11 is an elevational view of the upper body portion of the garment of FIG. 10 and in flattened and relaxed condition.

The garment illustrated in FIGS. 10–13 is similar in many respects to the garment illustrated in FIGS.1–5 and corresponding parts of the garment illustrated in FIGS. 10–13 will bear the same reference characters as the similar parts of the garment illustrated in FIGS. 1–5, except that the prime notation has been added to the reference characters used in describing the embodiment of the garment shown in FIGS. 10–13. The garment includes an upper body portion, broadly indicated at 10' including a tubular seamless knit upper trunk covering portion or body 11' having an upper neck opening 12' and outwardly extending shoulder seams 13', 14'. The raw cut lower edge forms a lower open free end 15' extending downwardly substantially below the waist and crotch of the wearer and to substantially the midpoint of the thighs of the wearer. As illustrated in FIG. 11, the lower free nonraveling end 15' of the body 11' extends below the sleeves 20', 21' and the raw cut lower edges forming lower free nonraveling ends 22', 23'. The body portion 11' is formed from a cut segment of a seamless tube which, when flattened and relaxed, as shown in FIG. 11, is substantially twelve inches wide and thirty-nine inches long from the upper neck opening 12' to the lower free end 15'. The upper ends of the sleeves 20', 21' are connected to the sleeve openings in the body portion 11' by connecting seams 24', 25' and the neck opening 12' is preferably provided with an overedge seam to prevent raveling of the fabric around the neck opening.

The lower body portion 30' (FIG. 12) comprises a pair of separate legs 32', 33' having raw cut upper edges forming free open upper nonraveling ends 35' and including inner tapering seams 36', 37' extending from a medial portion of the legs 32', 33' and also forming closure seams 38', 39' at the lower ends of the legs 32', 33'. The legs 32', 33' are formed from cut segments of seamless tubular fabric with the cut segments being oriented in accordance with the direction of the knitting of the fabric, as indicated by the arrows in FIG. 12. Thus, the cut upper ends 35' are at the first courses to be knit of the cut segment so that the raw cut edges at the free open upper ends 35' will not ravel and do not need to be seamed or hemmed.

Figure 12:
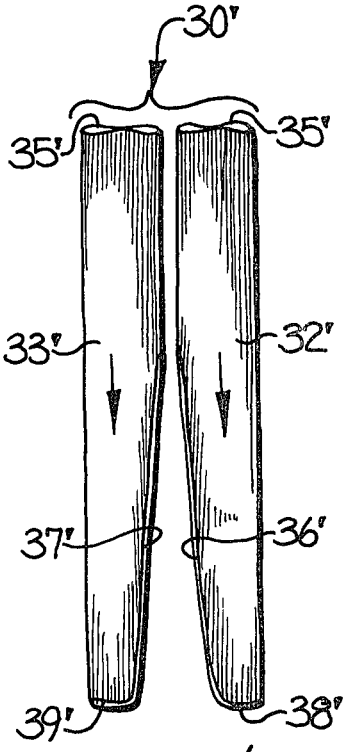
FIG. 12 is an elevational view of the lower body portion of the garment of FIG. 10 and shown in flattened and relaxed condition.

The legs 32', 33' are forty inches long from the top to the bottom and the tapered seams 36', 37' are twenty-five inches long from the bottom to the intermediate portion of the legs. The upper portion of the legs 32', 33' are six inches wide when in a flattened and relaxed condition, as illustrated in FIG. 12 and the seams 36', 37' taper the fabric downwardly so that the lower ends of the legs are four inches wide when in a flattened and relaxed condition. As illustrated in FIG. 10, the upper free ends 35' of the legs 32', 33' are adapted to extend upwardly beyond the upper ends of the legs of the wearer. The legs 32', 33' are longer than the corresponding legs of the patient and the upper ends of the legs 32', 33' are folded downwardly so that the legs 32', 33' correspond to the length of the legs of the patient. As shown in FIG. 10, the lower end of the body portion 11' is adapted to extend downwardly to approximately the middle portions of the upper thighs of the wearer so that the entire body, arms and legs of the wearer are covered by the garment. If desired, the lower ends of the sleeves 20', 21' may be folded up to expose the hands of the patient.

Figure 13:
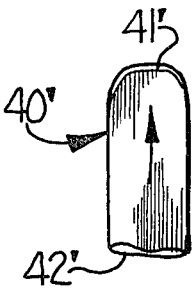
FIG. 13 is an elevational view of a cap shown in flattened and relaxed condition.

The cap, broadly indicated at 40' in FIG. 13, is formed of cut segments of a tubular seamless fabric and includes a curved upper closure seam 41' and a raw cut lower edge forming an open free lower end 42'. The cut segments are oriented so that the cap 40' is knit from the bottom to the top, as indicated by the arrow in FIG. 13, and the free lower end 42' will not ravel. The cap 40' is formed of the same type of knit material from which the legs 32' and 33' are formed and is substantially six inches wide and thirteen inches long when in a flattened and relaxed condition, as illustrated in FIG. 13.

The garment of FIGS. 10–13 is also adapted to substantially cover the entire body of the patient and is sufficiently stretchable to fit a wide range of body shapes and sizes. The garment is placed on the patient and the patient is brought to the operating room with the garment in position so that it is merely necessary for the doctor to move or cut away that portion of the garment in the area where the operation is to be performed.

Thus, the garment of the present invention aids in maintaining the body temperature of the patient during surgical operations and also during the recovery period. Since the garment of the present substantially covers the entire body of the patient, the garment also serves to protect the modesty of the patient when undergoing surgical or other types of treatment, such as radiological procedures and the like.

In the drawings and specification, there has been set forth preferred embodiments of the invention, and although specific terms are employed, they are used in a generic and descriptive sense only and not for purposes of limitation, the scope of the invention being defined in the claims.

That which is claimed is:

1. A garment for maintaining the body temperature of a patient, particularly during the time the patient is undergoing surgery in an operating room where the ambient temperature is usually maintained below the normal body temperature, said garment being constructed of cut segments of stretchable circular knit seamless fabric so that said garment has sufficient stretchability to fit a wide range of body sizes, said garment including an upper body portion comprising a cut fabric segment defining an upper trunk covering portion including an upper neck opening and having a free open lower end, said trunk covering portion being of a sufficient length to cover and extend below the waist of the wearer, a pair of sleeve openings, seams extending from opposite sides of said neck opening and to said sleeve openings, a pair of cut fabric segments defining a pair of sleeves having upper ends seamed to said sleeve openings of said trunk covering portion and having free open lower ends, said sleeves being of a sufficient length to cover and extend beyond the hands of the wearer, said cut fabric segments defining said upper trunk covering portion and said sleeves including opposing ends, one end of which will ravel and the other end of which will not ravel, said cut fabric segments being oriented so that said free open lower ends of said upper trunk covering portion and said sleeves are formed of the nonraveling raw cut ends of said cut segments, and a lower body portion including a pair of legs extending upwardly and covering at least the entire upper legs and extending downwardly and covering at least the feet of the wearer.

2. A garment according to claim 1 wherein said lower body portion is constructed of cut segments of stretchable circular knit seamless fabric, said lower body portion including a lower trunk covering portion with an upper end extending to the waist of the wearer, said lower trunk covering portion including a U-seam connecting slit edges of the upper ends of said legs, and wherein the upper ends of said legs are integral with said lower trunk covering portion, and the lower ends of said legs have free open lower ends extending beyond the feet of the wearer, said free open lower ends of said legs being formed of the nonraveling raw cut ends of said cut segments.

3. A garment according to claim 1 wherein said pair of legs each includes a free open upper end extending to the upper ends of the legs of the wearer, said legs being constructed of cut segments of circular knit seamless fabric with said free open upper ends of said legs being formed of the nonraveling raw cut ends of said cut segments, and wherein the lower ends of said legs are seamed closed and cover the feet of the wearer.

4. A garment according to claim 3 wherein the length of said upper body portion is such that said free open lower end of said upper trunk covering portion is positioned below said free open upper ends of said pair of legs.

5. A garment according to claim 1 wherein said circular knit seamless fabric is knit of cotton yarn and in a true rib construction.

6. A garment according to claim 5 wherein said true rib construction comprises stitch loops of every other wale facing outwardly of said garment and stitch loops of the remaining wales facing inwardly of said garment.

7. A garment according to claims 1, 2 or 3 including a cap constructed of a cut segment of circular knit seamless fabric and including an upper end with a curved seam forming a closed end, and a free open lower end, said free open lower end of said cap being formed of the nonraveling raw cut end of said cut segment.

8. A garment for maintaining the body temperature of a patient, particularly during the time the patient is undergoing surgery in an operating room where the ambient temperature is usually maintained below the normal body temperature, said garment being constructed of cut segments of stretchable circular knit seamless fabric so that said garment has sufficient stretchability to fit a wide range of body sizes, said garment including an upper body portion comprising an upper trunk covering portion including an upper neck opening and having a free open lower end, said trunk covering portion being of a sufficient length to cover and extend below the waist of the wearer, a pair of sleeve openings, seams extending from opposite sides of said neck opening and to said sleeve openings, and a pair of sleeves having upper ends seamed to said sleeve openings of said trunk covering portion and having free open lower ends, said sleeves being of a sufficient length to cover and extend beyond the hands of the wearer, said upper trunk covering portion and said sleeves comprising cut fabric segments including opposing ends, one end of which will ravel and the other end of which will not ravel, said cut fabric segments being oriented so that said free open lower ends of said upper trunk covering portion and said sleeves are formed of the nonraveling raw cut ends of said cut segments.

9. A method of forming a garment for maintaining the body temperature of a patient, particularly during the time the patient is undergoing surgery in an operating room where the ambient temperature is usually maintained below the normal body temperature, said garment including an upper body portion comprising an upper trunk covering portion of sufficient length to cover and extend below the waist and having a free open lower end, and a pair of sleeves having upper ends seamed to said upper trunk covering portion and being of sufficient length to cover and extend beyond the hands of the wearer with free open lower ends, said method comprising the steps of providing a first stretchable circular knit seamless fabric of a predetermined diameter, providing a second stretchable circular knit seamless fabric of a smaller diameter than said first stretchable circular knit seamless fabric, transversely cutting said first stretchable circular knit seamless fabric to form a cut body segment of a sufficient length to form said upper trunk covering portion, said cut body segment including one raw end which will ravel and an opposing nonraveling raw end, transversely cutting said second stretchable circular knit seamless fabric to form a pair of cut sleeve segments of a sufficient length to form said sleeves, said cut sleeve segments each including one raw end which will ravel and an opposing nonraveling raw end, orienting said cut body segment so that said nonraveling end forms said free open lower end of said trunk covering portion, orienting said cut sleeve segments so that said nonraveling ends form said free open lower ends of said sleeves, and seaming said raveling ends of said cut sleeve segments to said cut body segment adjacent said raveling end thereof.

10. A method according to claim 9 wherein said garment also includes a lower body portion comprising a lower trunk covering portion with an upper waist opening and a pair of legs with free open lower ends extending beyond the feet of the wearer, said method comprising the further steps of knitting a third length of stretchable circular knit seamless fabric of a diameter smaller than said first length of fabric and larger than said second length of fabric, transversely cutting said third length of fabric to form a pair of cut leg segments of a sufficient length to extend from the waist to a point beyond the feet, said cut leg segments each including one end which will ravel and a second end which will not ravel, orienting said cut leg segments so that said second ends form said free open lower ends of said legs, longitudinally slitting said cut leg segments adjacent said one end, seaming together the slit edges of said cut leg segments with a U-shaped seam to form said lower trunk covering portion, and binding the upper waist opening to prevent raveling of the knit fabric.

11. A method according to claim 9 wherein the step of binding the upper waist opening comprises attaching an elastic waistband to the waist opening.

12. A method according to claim 9 wherein said garment also includes a lower body portion comprising a pair of legs with free open upper ends and closed lower ends adapted to cover the feet of the wearer, said method comprising the further steps of knitting a third length of stretchable circular knit seamless fabric of a diameter smaller than said first length of fabric and larger than said second length of fabric, transversely cutting said third length of fabric, to form a pair of cut leg segments of a sufficient length to cover the feet and extend upwardly to the upper ends of the legs of the wearer, said cut leg segments each including one end which will ravel and a second end which will not ravel, orienting said cut leg segments so that said second ends form said free open upper ends of said legs, and seaming and closing said one end of said cut leg segments.

13. A method according to claims 9, 10 or 12 wherein said garment also includes a cap with a closed upper end and a free open lower end, said method comprising the further steps of knitting a length of stretchable circular knit seamless fabric of a predetermined diameter, transversely cutting said length of fabric to form a cut cap segment of a sufficient length to cover the head of the wearer, said cut cap segment including one end which will ravel and a second end which will not ravel, orienting said cut cap segment so that said second end forms said free open lower end, and seaming and closing said one end of said cut cap segment.

14. A method of forming a garment for maintaining the body temperature of a patient, particularly during the time the patient is undergoing surgery in an operating room where the ambient temperature is usually maintained below the normal body temperature, said garment including an upper body portion comprising an upper trunk covering portion of sufficient length to cover and extend below the waist and having a free open lower end, and a pair of sleeves having upper ends seamed to said upper trunk covering portion and being of sufficient length to cover and extend beyond the hands of the wearer with free open lower ends, said method comprising the steps of transversely cutting a first stretchable circular knit seamless fabric to form a cut body segment of a sufficient length to form said upper trunk covering portion, transversely cutting a second stretchable circular knit seamless fabric to form a pair of cut sleeve segments of a sufficient length to form said sleeves, said cut body segment and said cut sleeve segments each including one raw end which will ravel and an opposing nonraveling raw end, orienting said cut body segment so that said nonraveling end forms said free open lower end of said trunk covering portion, orienting said cut sleeve segments so that said nonraveling ends form said free open lower ends of said sleeves, and seaming said raveling ends of said cut sleeve segments to said cut body segment adjacent said raveling end thereof.

* * * * *